US010379469B2

(12) United States Patent
Takeuchi et al.

(10) Patent No.: US 10,379,469 B2
(45) Date of Patent: Aug. 13, 2019

(54) FIXING APPARATUS HAVING ACTUATOR FOR MOVING PRESSURE MEMBER IN ENDLESS BELT

(71) Applicant: Brother Kogyo Kabushiki Kaisha, Nagoya-shi, Aichi-ken (JP)

(72) Inventors: Kenji Takeuchi, Nagoya (JP); Masahito Kajita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/927,589

(22) Filed: Mar. 21, 2018

(65) Prior Publication Data

US 2018/0284662 A1 Oct. 4, 2018

(30) Foreign Application Priority Data

Mar. 28, 2017 (JP) ..... 2017-063388

(51) Int. Cl.
*G03G 15/20* (2006.01)

(52) U.S. Cl.
CPC ..... *G03G 15/2053* (2013.01); *G03G 15/2028* (2013.01); *G03G 15/2032* (2013.01); *G03G 2215/2022* (2013.01); *G03G 2215/2029* (2013.01); *G03G 2215/2038* (2013.01)

(58) Field of Classification Search
CPC ..... G03G 15/2032; G03G 15/2053; G03G 15/2028; G03G 2215/2022; G03G 2215/2029; G03G 2215/2038
See application file for complete search history.

(56) References Cited

U.S. PATENT DOCUMENTS

| | | | | |
|---|---|---|---|---|
| 8,649,697 | B2 | 2/2014 | Arakawa | |
| 9,488,942 | B2 | 11/2016 | Ishimori | |
| 2006/0133869 | A1* | 6/2006 | Sata | G03G 15/2032 399/329 |
| 2011/0044737 | A1* | 2/2011 | Takada | G03G 15/2025 399/329 |
| 2012/0070173 | A1 | 3/2012 | Arakawa | |

(Continued)

FOREIGN PATENT DOCUMENTS

| | | | |
|---|---|---|---|
| JP | 2007-333991 | A | 12/2007 |
| JP | 2012-068285 | A | 4/2012 |

(Continued)

*Primary Examiner* — Sandra Brase
(74) *Attorney, Agent, or Firm* — Banner & Witcoff, Ltd.

(57) ABSTRACT

A fixing apparatus includes: first and second pressure members each of which is in contact with an inner circumferential surface of an endless belt and nips the endless belt between itself and a cylindrical member; a frame supporting the first and second pressure members; an actuator that moves the first pressure member between a first position and a second position in a movement direction of a portion, of the endless belt, positioned between the first and second pressure members; and an elastic body that generates nipping force to nip the endless belt. The nipping force by the elastic body is generated between the cylindrical member and the first and second pressure members, both in a case that the first pressure member is positioned in the first position and a case that the first pressure member is positioned in the second position.

17 Claims, 12 Drawing Sheets

(56) References Cited

U.S. PATENT DOCUMENTS

| | | | | |
|---|---|---|---|---|
| 2013/0004218 | A1* | 1/2013 | Tsueda | G03G 15/2032 399/329 |
| 2016/0246227 | A1 | 8/2016 | Ishimori | |
| 2018/0067430 | A1* | 3/2018 | Sone | G03G 15/2032 |

FOREIGN PATENT DOCUMENTS

| | | | |
|---|---|---|---|
| JP | 2013-174748 | A | 9/2013 |
| JP | 2014-026295 | A | 2/2014 |
| JP | 2015-161706 | A | 9/2015 |
| JP | 2016-156951 | A | 9/2016 |

* cited by examiner

FIXING APPARATUS HAVING ACTUATOR FOR MOVING PRESSURE MEMBER IN ENDLESS BELT

CROSS REFERENCE TO RELATED APPLICATION

The present application claims priority from Japanese Patent Application No. 2017-063388 filed on Mar. 28, 2017, the disclosure of which is incorporated herein by reference in its entirety.

BACKGROUND

Field of the Invention

The present invention relates to a fixing apparatus configured to thermally fix a developer image transferred to a recording medium.

Description of the Related Art

There is conventionally known a fixing apparatus including two pressure members inside an endless belt. For example, Japanese Patent Application Laid-open No. 2014-26295 discloses a configuration in which an endless belt is nipped between a fixing roller provided outside the endless belt and a pressure pad provided inside the endless belt and between the fixing roller and a pressure roller provided inside the endless belt.

SUMMARY

According to an aspect of the present teaching, there is provided a fixing apparatus, including: an endless belt; a cylindrical member; a first pressure member which is in contact with an inner circumferential surface of the endless belt and is configured to nip the endless belt between itself and the cylindrical member; a second pressure member which is in contact with the inner circumferential surface of the endless belt and is configured to nip the endless belt between itself and the cylindrical member; a frame configured to support the first pressure member and the second pressure member; an actuator configured to move the first pressure member between a first position and a second position different from the first position in a movement direction of a portion, of the endless belt, positioned between the first pressure member and the second pressure member; and an elastic body configured to generate nipping force to nip the endless belt between the first pressure member and the cylindrical member and between the second pressure member and the cylindrical member, wherein the nipping force by the elastic body is generated between the first pressure member and the cylindrical member and between the second pressure member and the cylindrical member, both in a case that the first pressure member is positioned in the first position and a case that the first pressure member is positioned in the second position.

BRIEF DESCRIPTION OF THE DRAWINGS

FIGS. 6A to 6C are cross-sectional views each depicting a structure around a stay, wherein FIG. 6A is a cross-sectional view taken along a line VIA-VIA of FIG. 5, FIG. 6B is a cross-sectional view taken along a line VIB-VIB of FIG. 5, and FIG. 6C is a cross-sectional view taken along a line VIC-VIC of FIG. 5.

DESCRIPTION OF THE EMBODIMENTS

First Embodiment

A first embodiment of the present teaching is described below in detail with reference to the drawings as appropriate. In the following, a schematic configuration of a laser printer 1 including a fixing apparatus 100 of the present teaching is explained first, and then characteristics of the present teaching are explained in detail.

Figure 1:
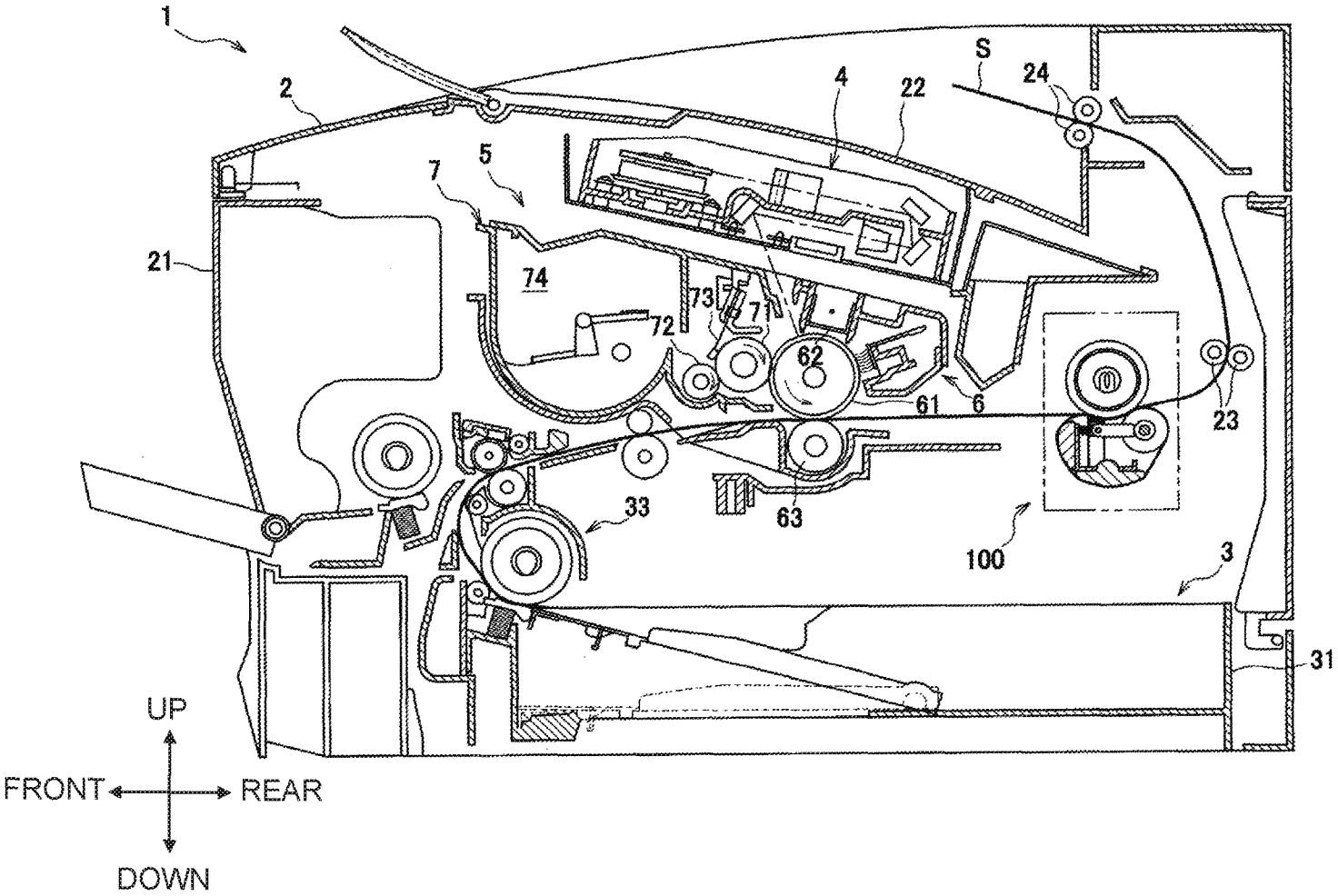
FIG. 1 schematically depicts a configuration of a laser printer including a fixing apparatus according to a first embodiment of the present teaching.

In the following, directions are defined as indicated in FIG. 1. That is, the left side in FIG. 1 is defined as "front", the right side in FIG. 1 is defined as "rear", the near side in FIG. 1 is defined as "right", and the far side in FIG. 1 is defined as "left". The up-down direction in FIG. 1 is defined as "up" and "down".

As depicted in FIG. 1, the laser printer 1 includes a casing 2 that is mainly provided with a feed unit 3 supplying a sheet S, an exposure apparatus 4, a process cartridge 5 transferring a toner image on the sheet S, and the fixing apparatus 100 thermally fixing the toner image on the sheet S.

The feed unit 3, which is disposed in a lower portion of the casing 2, includes a feed tray 31 and a feed mechanism 33. The sheet S stored in the feed tray 31 is supplied toward the process cartridge 5 by the feed mechanism 33.

The exposure apparatus 4, which is disposed in an upper portion of the casing 2, includes a laser emitting unit (not depicted), a polygon mirror, a lens, a reflecting mirror, and the like (reference numerals thereof are omitted in the drawings). In the exposure apparatus 4, a laser beam (see a dot-dash chain line in FIG. 1) that is emitted from the laser emitting unit on the basis of image data is scanned on a surface of a photosensitive drum 61 at high speed to expose the surface of the photosensitive drum 61.

The process cartridge 5 is disposed below the exposure apparatus 4. The process cartridge 5 is removably attached to the casing 2 through an opening of the casing 2. An openable and closable front cover 21 is provided in the casing 2 to cover the opening. The process cartridge 5 includes a drum unit 6 and a developing unit 7.

The drum unit 6 mainly includes the photosensitive drum 61, a charging unit 62, and a transfer roller 63. The developing unit 7, which is removably attached to the drum unit 6, mainly includes a developing roller 71, a supply roller 72, a layer-thickness regulating blade 73, and a toner storage 74 storing a toner.

In the process cartridge 5, the surface of the photosensitive drum 61 is uniformly charged by the charging unit 62, then is exposed with the laser light from the exposure apparatus 4 through the high-speed scanning to form an electrostatic latent image based on image data on the photosensitive drum 61. The toner in the toner storage 74 is supplied to the developing roller 71 via the supply roller 72, enters between the developing roller 71 and the layer-thickness regulating blade 73, and is carried, as a thin layer having a certain thickness, on the developing roller 71.

The toner carried on the developing roller 71 is supplied from the developing roller 71 to the electrostatic latent image formed on the photosensitive drum 61. This visualizes the electrostatic latent image (the electrostatic latent image is made as a visual image), and a toner image is formed on the photosensitive drum 61. Allowing the sheet S to pass between the photosensitive drum 61 and the transfer roller 63 transfers the toner image formed on the photosensitive drum 61 onto the sheet S.

The fixing apparatus 100 is disposed on a rear side of the process cartridge 5. The toner image is thermally fixed on the sheet S when the sheet S having the toner image transferred thereon passes the fixing apparatus 100. The sheet S on which the toner image is thermally fixed is discharged on a discharge tray 22 by using conveyance rollers 23 and 24.

Figure 2:
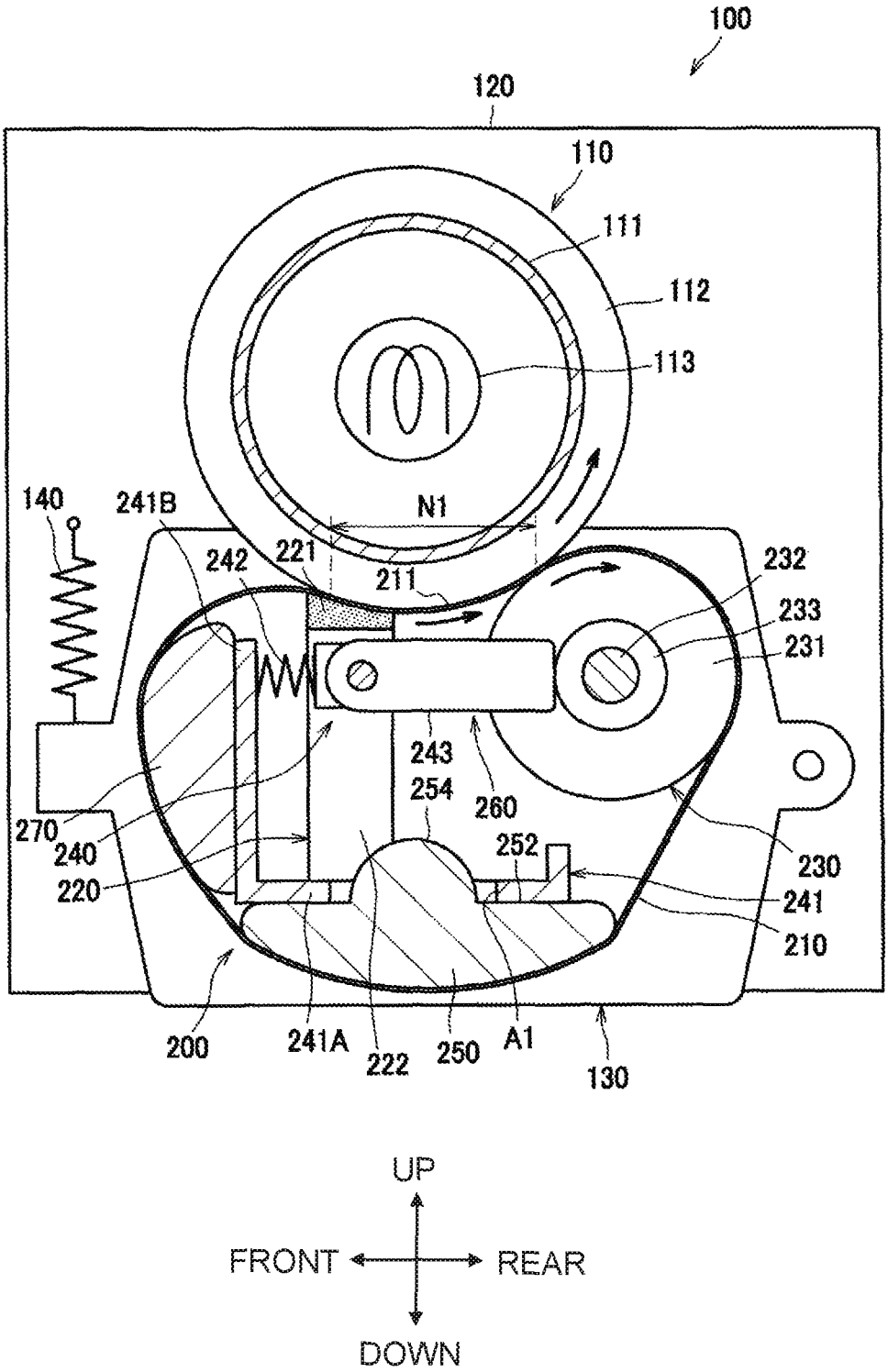
FIG. 2 is a cross-sectional view, when seen from the right side, of the fixing apparatus of which nip width is a first width.

As depicted in FIG. 2, the fixing apparatus 100 includes a heating roller 110 that is an exemplary cylindrical member, a pressure unit 200, a fixing frame 120, a pressure arm 130 that is an exemplary frame, and an extension coil spring 140 that is an exemplary elastic body. The fixing frame 120 is formed from, for example, resin.

The heating roller 110 rotates around a rotation axis extending in a left-right direction. The heating roller 110 includes a cylindrical element pipe 111 made of metal and an elastic layer 112 provided on an outer circumferential surface of the element pipe 111. The elastic layer 112 is formed from an elastically deformable material, such as silicone rubber. The element pipe 111 is rotatably supported by the fixing frame 120. A heater 113 is provided in the element pipe 111.

The pressure arm 130 is a plate-like member formed from metal and the like. A first end of the pressure arm 130 is rotatably supported by the fixing frame 120. The pressure arms 130 are disposed on the left and right sides of the pressure unit 200, respectively to support ends of the pressure unit 200 in the left-right direction.

The extension coil spring 140 biases the pressure arm 130 upward (specifically, toward the pressure roller 110), generating nipping pressure between the pressure roller 110 and the pressure unit 200. The extension coil spring 140 is coupled to the fixing frame 120 and to a second end of the pressure arm 130 on a side opposite to a rotation axis of the pressure arm 130.

Although not depicted in the drawings, the fixing apparatus 100 includes a switching mechanism that switches a position of the pressure arm 130 from a pressure position depicted in FIG. 2 to a retract position (not depicted in the drawings) separated further from the heating roller 110 than the pressure position. When the pressure arm 130 is positioned in the pressure position, predefined nipping pressure is generated between the pressure roller 110 and the pressure unit 200. When the pressure arm 130 is positioned in the retract position, the nipping pressure between the heating roller 110 and the pressure unit 200 is smaller than the predefined nipping pressure (e.g., zero).

The pressure unit 200 is disposed below the heating roller 110. The pressure unit 200 includes an endless belt 210, a pressure pad 220 that is an exemplary first pressure member, a pressure roller 230 that is an exemplary second pressure member, an actuator 240, a movable guide 250 that is an exemplary belt guide, and a displacement mechanism 260.

The endless belt 210 has flexibility and heat resistance to heat of the heating roller 110. The endless belt 210 is rotated (moved) by rotation of the heating roller 110 that is frictionally engaged with the endless belt 210. Specifically, the endless belt 210 moves clockwise in FIG. 2. The endless belt 210 is disposed such that its width direction extends in the left-right direction. The width of the endless belt 210 (i.e., the length in the left-right direction) is longer than the length of the pressure pad 220 in the left-right direction and the length of a roller body 231, as described later, of the pressure roller 230 in the left-right direction.

A predefined portion 211, of the endless belt 210, positioned between the pressure pad 220 and the pressure roller 230 moves in a substantially front-rear direction. That is, in the first embodiment, a movement direction of the predefined portion 211 corresponds to the front-rear direction.

The pressure pad 220 is movable in the front-rear direction relative to the pressure arm 130 on the front side of the pressure roller 230, that is, on the upstream side in the above movement direction. The pressure pad 220 includes a pad body 221 formed from an elastically deformable material, such as silicone rubber, and a holder 222 supporting the pad body 221.

The pad body 221 is in contact with an inner circumferential surface of the endless belt 210 to nip the endless belt 210 between itself and the pressure roller 110. The pad body 221 has a rectangular parallelopiped shape that is long in the left-right direction. The pad body 221 is softer than the elastic layer 112 of the heating roller 110. Namely, the pad body 221 is easy to be elastically deformed. The pad body 221 is fixed to an upper surface of the holder 222.

The holder 222 has a rectangular parallelopiped shape that is long in the left-right direction. The holder 222 is larger than the pad body 221 in the up-down direction. A lower surface of the holder 222 is positioned below the pressure roller 230 in the up-down direction. The holder 222 is supported by the pressure arm 130 via a stay 241 as described later. This causes the pressure arm 130 to press the pressure pad 220 against the pressure roller 110, generating the nipping force to nip the endless belt 210 between the pressure pad 220 and the pressure roller 110.

The lower surface of the holder 222 is slidably movable on a lower wall 241A of the stay 241, as described later, in the front-rear direction. This allows the pressure pad 220 to be movable, in the front-rear direction, between a first position depicted in FIG. 2 and a second position depicted in FIG. 3 different from the first position.

In the first embodiment, when the pressure pad 220 is positioned in the first position, a distance between the pressure pad 220 and the pressure roller 230 is a first distance. When the pressure pad 220 is positioned in the second position, a distance between the pressure pad 220 and the pressure roller 230 is a second distance smaller than the first distance. Namely, the pressure pad 220 in the second position is closer to the pressure roller 230 than the pressure pad 220 in the first position. The first and second positions are determined so that the nipping force between the pressure pad 220 and the heating roller 110 caused by the extension coil spring 140 is generated both of when the pressure pad 220 is positioned in the first position and when the pressure pad 220 is positioned in the second position. In that configuration, when the pressure pad 220 is positioned in the first position, a width, in the front-rear direction, of a nip portion that is a contact portion of the endless belt 210 with the heating roller 110 is a first width N1. When the pressure pad 220 is positioned in the second position, the width of the nip portion in the front-rear direction is a second width N2 smaller than the first width N1.

The pressure roller 230 rotates around a rotation axis extending along the left-right direction. The pressure roller 230 is in contact with the inner circumferential surface of the endless belt 210 to nip the endless belt 210 between itself and the heating roller 110. The pressure roller 230 includes the roller body 231 having a cylindrical outer circumferential surface and a rotation shaft 232 extending from end surfaces of the roller body 231 in the left-right direction.

The roller body 231 is formed from an elastically deformable material, such as silicone rubber. The roller body 231 is harder than the elastic layer 112 of the heating roller 110. Namely, the roller body 231 is not likely to be elastically deformed. Although neither the elastic layer 112 of the heating roller 110 nor the roller body 231 is deformed in FIG. 2, the elastic layer 112 of the heating roller 110 is actually deformed to extend along the circumference surface of the roller body 231.

The rotation shaft 232 is rotatably supported by a bearing 233 fixed to the pressure arm 130. Namely, the pressure roller 230 is supported by the pressure arm 130 via the bearing 233. This causes the pressure arm 130 to press the pressure roller 230 against the heating roller 110, generating the nipping force to nip the endless belt 210 between the pressure roller 230 and the heating roller 110. In the first embodiment, each of the pressure roller 230 and the bearing 233 corresponds to the second pressure member.

The pressure roller 230 is not moved in the front-rear direction and the up-down direction relative to the pressure arm 130 because the rotation shaft 232 is supported by the bearing 233 which is fixed to the pressure arm 130. In other words, the pressure roller 230 is not moved in a direction orthogonal to the width direction of the endless belt 210 relative to the pressure arm 130. This constantly presses the pressure roller 230 against the heating roller 110 regardless of the position of the pressure pad 220. Thus, the nipping force between the pressure roller 230 and the heating roller 110 caused by the extension coil spring 140 is generated both of when the pressure pad 220 is positioned in the first position and when the pressure pad 220 is positioned in the second position.

Figure 3:
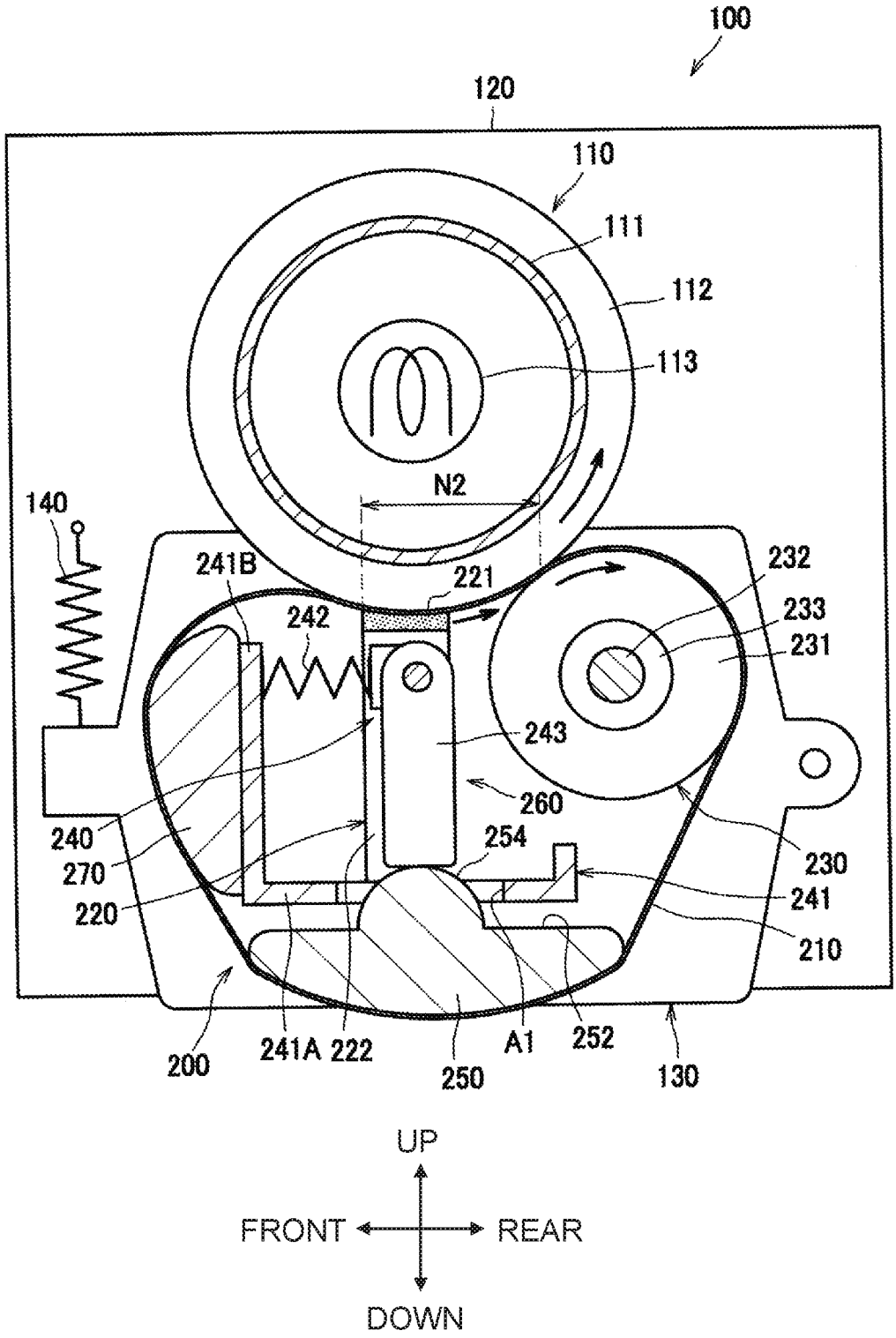
FIG. 3 is a cross-sectional view, when seen from the right side, of the fixing apparatus of which nip width is a second width.

The actuator 240 moves the pressure pad 220 in the front-rear direction between the first position depicted in FIG. 2 and the second position depicted in FIG. 3. The actuator 240 mainly includes the stay 241, a compression coil spring 242 that is an exemplary first spring, a cam 243, a swing gear G1, a driving gear G2, and a pivot shaft 243A depicted in FIGS. 7A and 7B.

Figure 4:
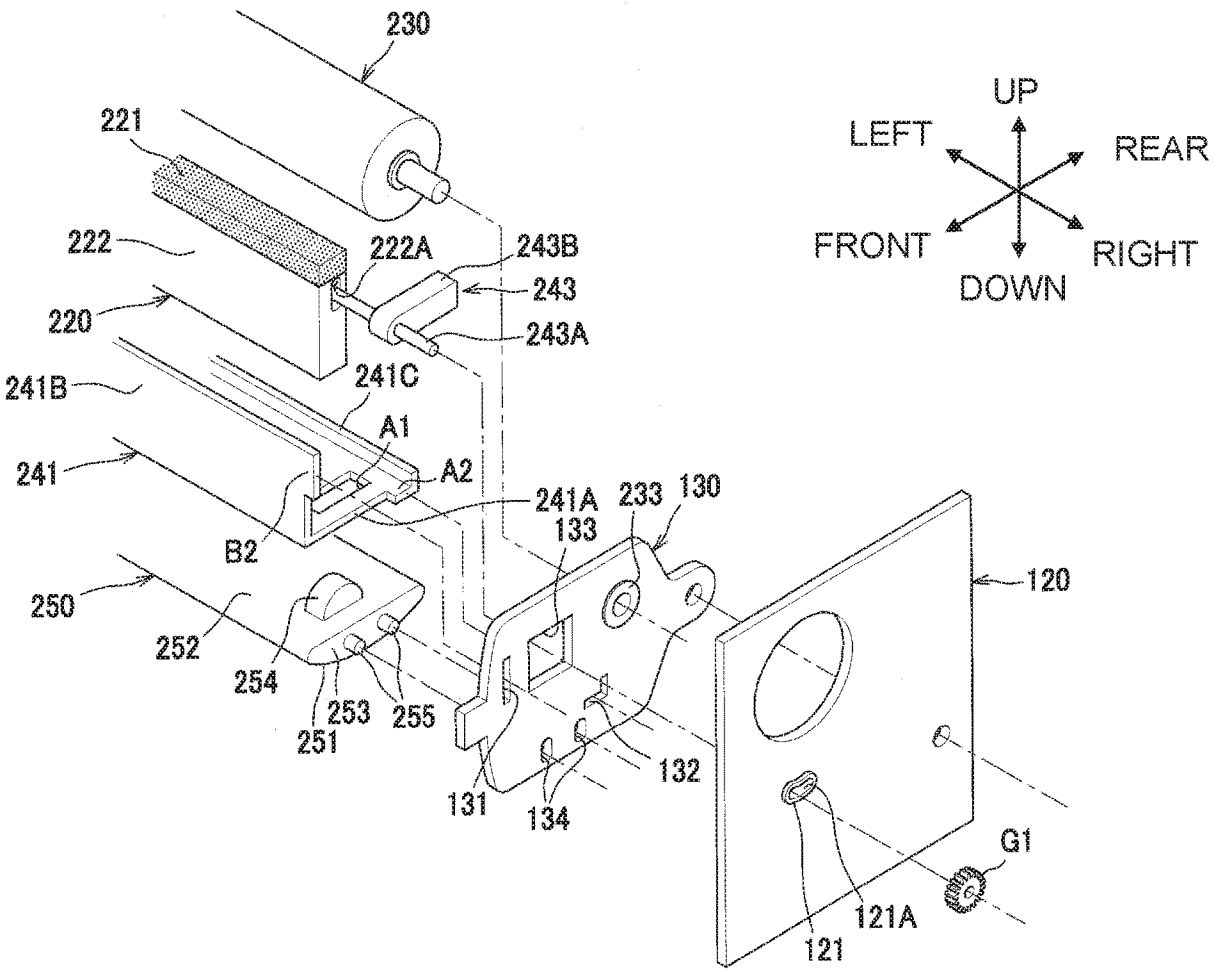
FIG. 4 is a perspective view of the fixing apparatus of which components are disassembled.
Figure 6A:
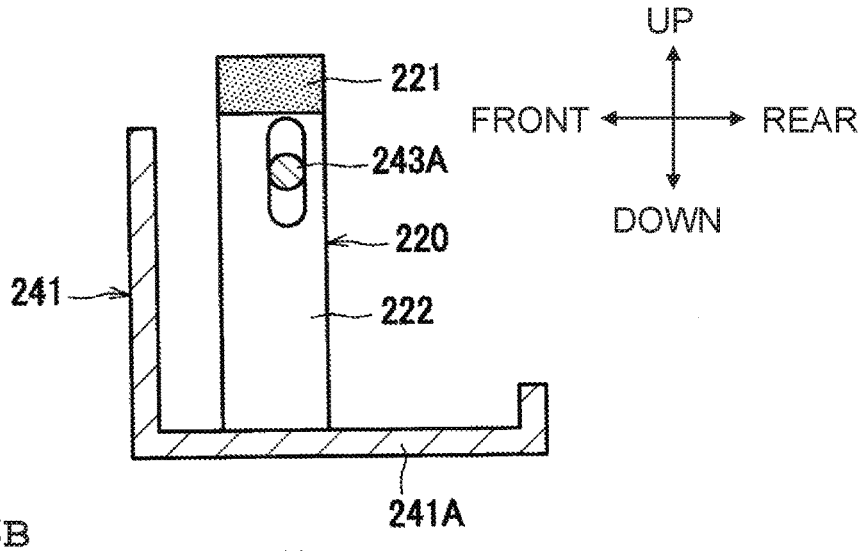

As depicted in FIG. 4, the stay 241 is a member that is long in the left-right direction. Ends of the stay 241 in the left-right direction are fixed to the respective pressure arms 130. The stay 241 includes a lower wall 241A, a front wall 241B extending upward from a front end of the lower wall 241A, and a rear wall 241C extending upward from a rear end of the lower wall 241A. The lower wall 241A supports the pressure pad 220 from below (see FIG. 6A).

Ends of the lower wall 241A in the left-right direction each include a hole A1 passing through in the up-down direction. A protrusion 254 of the movable guide 250 as described later is inserted into the hole A1. The holes A1 are disposed at the same positions as cam bodies 243B and the protrusions 254 of the movable guide 250 in the left-right direction (see FIGS. 5 and 6C). Rear ends of end surfaces of the lower wall 241A in the left-right direction each include a protrusion A2 protruding toward the pressure arm 130.

The front wall 241B protrudes upward beyond the rear wall 241C. Upper portions of end surfaces of the front wall 241B in the left-right direction each include a protrusion B2 protruding toward the pressure arm 130. As depicted in FIG. 2, a fixing guide 270, which guides the inner circumferential surface of the endless belt 210, is fixed to a front surface of the front wall 241B. An outer surface, of the fixing guide 270, which is in contact with the endless belt 210 has a substantially arc shape in cross section.

As depicted in FIG. 4, the rear wall 241C extends from a front end of the protrusion A2 disposed on the left side of the lower wall 241A to a front end of the protrusion A2 disposed on the right side of the lower wall 241A. The pressure arm 130 includes a first support hole 131 that supports the protrusion B2 of the stay 241 and a L-shaped second support hole 132 that supports the protrusion A2 of the stay 241 and an end of the rear wall 241C in the left-right direction. The stay 241, supported by the support holes 131 and 132 of the pressure arm 130, is not moved relative to the pressure arm 130.

Figure 5:
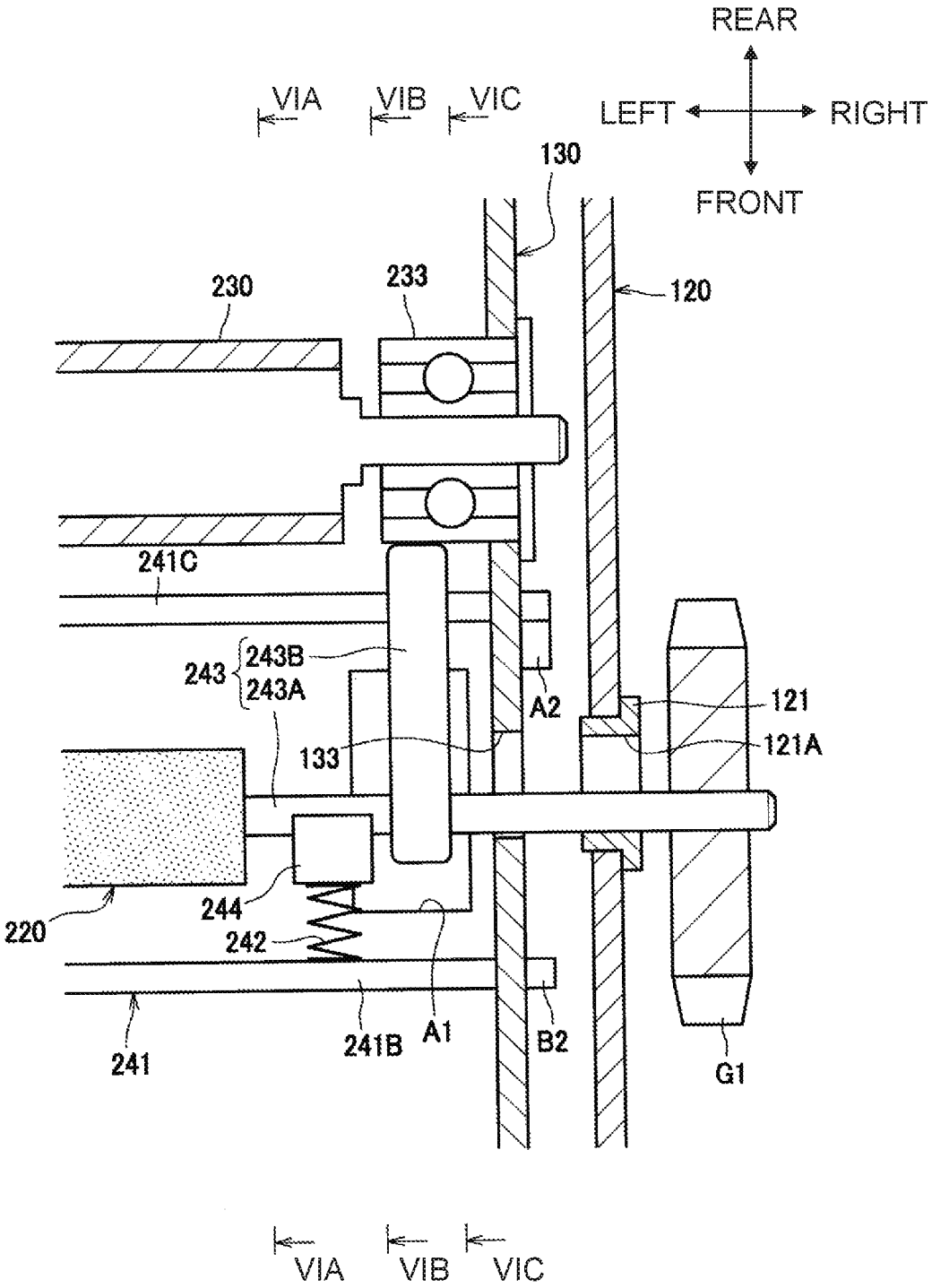
FIG. 5 is a cross-sectional view, when seen from the above, of the fixing apparatus taken along a surface perpendicular to an up-down direction.
Figure 6B:
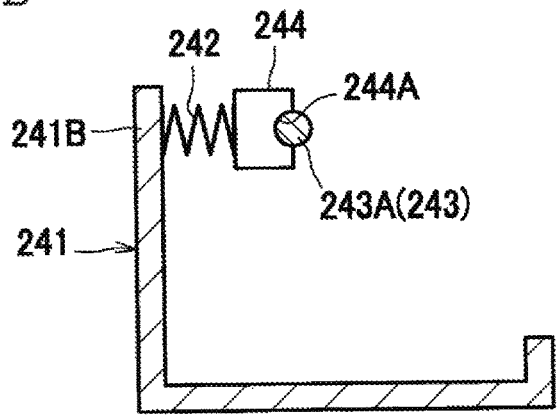
Figure 6C:
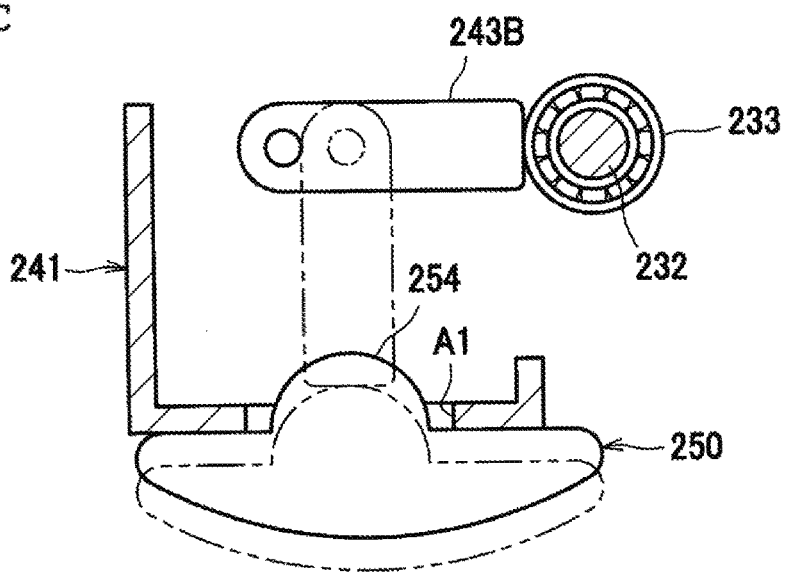

As depicted in FIG. 5, the compression coil spring 242 biases the pressure pad 220 from the first position toward the second position. In this embodiment, the compression coil spring 242 biases the pressure pad 220 toward the pressure roller 230. The compression coil spring 242 is disposed between the cam body 243B and the pressure pad 220 in the left-right direction. A front end of the compression coil spring 242 is fixed to a rear surface of the front wall 241B of the stay 241. A rear end of the compression coil spring 242 includes a contact member 244 that is in contact with the pivot shaft 243A of the cam 243. As depicted in FIG. 6B, the contact member 244 includes a concave 244A having a substantially a half-cylindrical shape along an outer circumferential surface of the pivot shaft 243A of the cam 243.

As depicted in FIG. 4, the cam 243 includes the pivot shaft 243A and the cam body 243B that pivots together with the pivot shaft 243A. The pivot shaft 243A is disposed to extend along the width direction of the endless belt 210 and to pass through the holder 222 in the left-right direction. Specifically, the holder 222 includes a long hole 222A passing through in the left-right direction, and the pivot shaft 243A is disposed to pass through the long hole 222A. Namely, the cam 243 is provided in the pressure pad 220 such that the pivot shaft 243A is inserted into the long hole 222A to be engaged therewith. The length of the long hole 222A is longer than an outer diameter of the pivot shaft 243A in a direction in which the nipping force between the pressure pad 220 and the heating roller 110 is generated, namely, in the up-down direction.

The long hole 222A is long in the up-down direction. The pivot shaft 243A is movable relative to the holder 222 in the up-down direction. The length of the hole 222A in the up-down direction is not less than a movement amount (a movement amount from the pressure position to the retract position described above) of the pressure arm 130 in the up-down direction. A lower end of the long hole 222A is positioned below the pivot shaft 243A of the cam 243 when the pressure arm 130 is positioned in the pressure position (see FIG. 6A).

The cam bodies 243B are provided on both ends of the holder 222 in the left-right direction. Each cam body 243B, which protrudes outward from the pivot shaft 243A in a diametral direction of the pivot shaft 243A, can pivot together with the pivot shaft 243A. An end surface of the cam body 243B farthest from the pivot shaft 243A faces rearward while having contact with the bearing 233 when the pressure pad 220 is positioned in the first position depicted in FIG. 2. Namely, the pressure pad 220 is positioned in the first position in a state where the end surface of the cam body 243B is in contact with the bearing 233.

The end surface of the cam body 243B is separated from (out of contact with) the bearing 233 when the pressure pad 220 is positioned in the second position depicted in FIG. 3. Namely, the pressure pad 220 is positioned in the second position in a state where the end surface of the cam body 243B is separated from the bearing 233. The end surface of the cam body 243B faces downward while having contact with the protrusion 254 of the movable guide 250 when the pressure pad 220 is positioned in the second position depicted in FIG. 3.

An end of the pivot shaft 243A passes through an insertion hole 133 of the pressure arm 130 and is supported by an arc-like bearing 121 of the fixing frame 120. The bearing 121 includes an arc-like hole 121A that supports the pivot shaft 243A passing therethrough. This allows the pivot shaft 243A to be movable along the arc-like hole 121A in the substantially front-rear direction.

The pivot shaft 243A is inserted into the insertion hole 133. The length of the insertion hole 133 in the front-rear direction is longer than the outer diameter of the pivot shaft 243A. Specifically, the length of the insertion hole 133 in the front-rear direction is not less than a movement amount of the pivot shaft 243A in the front-rear direction, and the length of the insertion hole 133 in the up-down direction is not less than the movement amount of the pressure arm 130 in the up-down direction. This prevents the pressure arm 130 from interfering with the pivot shaft 243A.

The end of the pivot shaft 243A protrudes beyond the fixing frame 120 in the left-right direction. The swing gear G1 is fixed to the end of the pivot shaft 243A.

Figure 7A:
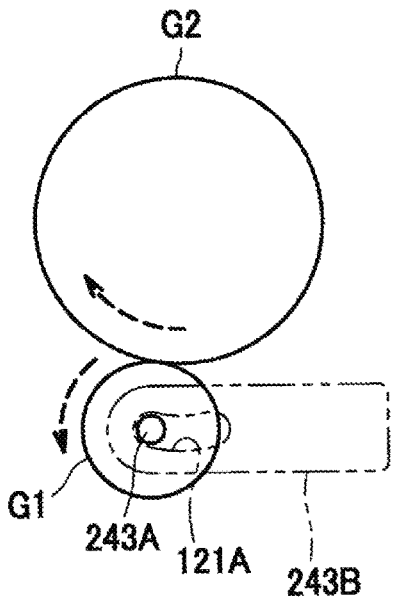
FIGS. 7A and 7B each depict movement of a swing gear and a cam.

As depicted in FIG. 7A, the swing gear G1, which engages with the driving gear G2 that is rotatably supported by the fixing frame 120, moves around the driving gear G2, specifically, swings around the driving gear G2. In order to move the swing gear G1 around the driving gear G2, a well known swing gear mechanism may be adopted, for example, by providing an arm member coupling a rotation shaft of the driving gear G2 with the pivot shaft 243A inserted in the swing gear G1. The pivot shaft 243A is positioned in a front end of the arc-like hole 121A when the pressure pad 220 is positioned in the first position depicted in FIG. 2. In that situation, a front end of the cam body 243B faces rearward.

Figure 7B:
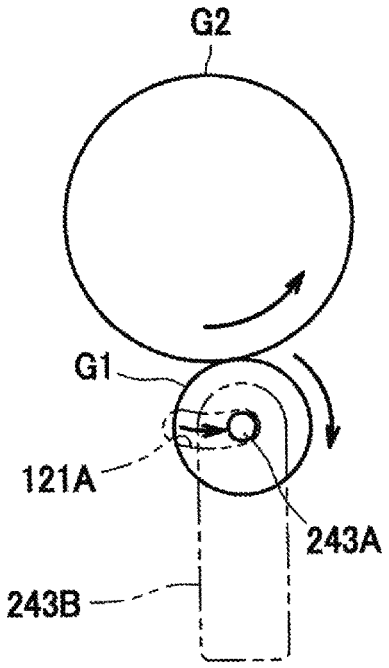
Figure 7B:
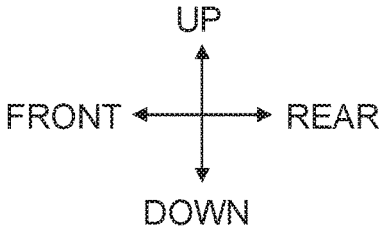

When rotation driving force in a predefined direction is transmitted from a driving source (not depicted in the drawings) to the driving gear G2, as depicted in FIG. 7B, the driving gear G2 rotates counterclockwise as indicated in the drawing and the swing gear G1 moves counterclockwise as indicated in the drawing around the driving gear G2 while rotating clockwise as indicated in the drawing. In that situation, the pivot shaft 243A moves from the front end to a rear end of the arc-like hole 121A while pivoting clockwise as indicated in the drawing. The rearward movement of the pivot shaft 243A is assisted by biasing force of the compression coil spring 242 (see FIG. 2), thus moving the pivot shaft 243A rearward smoothly. The pivot of the pivot shaft 243A causes the cam body 243B to pivot clockwise, thus switching an orientation of the front end of the cam body 243B from the rear side to the lower side.

When rotation driving force in a direction opposite to the predefined direction is transmitted from the driving source (not depicted in the drawings) to the driving gear G2, as depicted in FIG. 7A, the driving gear G2 rotates clockwise as indicated in the drawing and the swing gear G1 moves clockwise as indicated in the drawing around the driving gear G2 while rotating counterclockwise as indicated in the drawing. In that situation, the pivot shaft 243A moves from the rear end to the front end of the arc-like hole 121A while pivoting counterclockwise as indicated in the drawing. The pivot of the pivot shaft 243A causes the cam body 243B to pivot counterclockwise, thus switching the orientation of the front end of the cam body 243B from the lower side to the rear side. In a process of switching the orientation of the front end of the cam body 243B from the lower side to the rear side, reaction force of the pressing force of the front end of the cam body 243B against the bearing 233 (see FIG. 2) moves the pressure pad 220 from the second position to the first position against the biasing force of the compression coil spring 242 (see FIG. 2).

The movement of the pivot shaft 243A in the front-rear direction moves the pressure pad 220 engaged with the pivot shaft 243A in the front-rear direction. Thus, the pressure pad 220 can appropriately move between the first position and the second position. Fitting the pivot shaft 243A in the long hole 222A, which is formed in the pressure pad 220 and is long in the up-down direction, allows the long hole 222A to absorb movement of the pivot shaft 243A along the arc-like hole 121A in the up-down direction. This prevents the pressure pad 220 from moving in the up-down direction.

As depicted in FIG. 2, the movable guide 250 guides the inner circumferential surface of the endless belt 210. The movable guide 250 is movable, in the up-down direction, between a third position depicted in FIG. 2 and a fourth position (a position depicted in FIG. 3) separated further from the pivot center of the cam 243 than the third position. As depicted in FIG. 4, the movable guide 250 includes a guide surface 251, an upper surface 252, and an end surface 253. The guide surface 251 has a substantially arc shape in cross section and is in contact with the inner circumferential surface of the endless belt 210. The upper surface 252 is positioned on a side opposite to the guide surface 251 in the up-down direction. The upper surface 252 is perpendicular to the up-down direction. As depicted in FIG. 2, the upper surface 252 is in contact with the lower wall 241A of the stay 241 when the movable guide 250 is positioned in the third position. The upper surface 252 is separated from the lower wall 241A when the movable guide 250 is positioned in the fourth position.

The protrusions 254 protruding upward from the upper surface 252 are formed in ends of the movable guide 250 in the left-right direction. The protrusion 254 has a substantially arc shape in cross section that is convex upward. The protrusion 254 protrudes upward beyond the lower wall 241A through the hole A1 of the lower wall 241A of the stay 241 when the movable guide 250 is positioned in the third position.

The end surface 253, which is orthogonal to the left-right direction, connects an end of the upper surface 252 in the left-right direction and an end of the guide surface 251 in the left-right direction. The end surface 253 includes two protrusions 255 protruding toward the pressure arm 130. The protrusions 255 are disposed at an interval in the front-rear direction.

The pressure arm 130 includes two long holes 134 that movably support the protrusions 255 in the up-down direction. This allows the movable guide 250 to move in the up-down direction relative to the pressure arm 130.

The displacement mechanism 260 displaces a position of the movable guide 250 along with movement of the actuator 240. Specifically, the displacement mechanism 260 is configured to move the movable guide 250 from the third position (the position depicted in FIG. 2) to the fourth position (the position depicted in FIG. 3) when the movement of the actuator 240 moves the pressure pad 220 from the first position (the position depicted in FIG. 2) to the second position (the position depicted in FIG. 3). Further, the displacement mechanism 260 is configured to move the movable guide 250 from the fourth position to the third position when the movement of the actuator 240 moves the pressure pad 220 from the second position to the first position.

Specifically, the displacement mechanism 260 includes the cam 243, the protrusions 255 of the movable guide 250, the long holes 134 of the pressure arm 130, and an extension coil spring (not depicted in the drawings) that biases the movable guide 250 from the fourth position toward the third position. The cam 243 is in contact with the protrusion 254 of the movable guide 250 to hold the movable guide 250 in the fourth position (see FIG. 3) when the pressure pad 220 is positioned in the second position. The cam 243 is separated from the movable guide 250 (see FIG. 2) when the pressure pad 220 is positioned in the first position.

Next, the movement and operation of components or parts of the fixing apparatus 100 are explained. The movement and operation of components or parts when the pressure pad 220 is moved from the first position to the second position are explained first.

When the pressure pad 220 is moved in the front-rear direction, at first, the position of the pressure arm 130 is switched from the pressure position to the retract position. This releases the nipping pressure between the heating roller 110 and the pressure pad 220, making it possible to move the pressure pad 220 easily. In the following explanation, movement of the pressure pad 220 is explained with reference to FIGS. 2 and 3, wherein it is assumed that the heating roller 110 is separated from the pressure unit 200.

As depicted in FIG. 2, when the rotation driving force in the predefined direction is inputted to the driving gear G2 depicted in FIG. 7A in a state where the pressure pad 220 released from the nipping pressure is positioned in the first position, the swing gear G1 rotates and moves to the position depicted in FIG. 7B. This moves the pivot shaft 243A of the cam 243 rearward along the arc-like hole 121A and switches the orientation of the end surface of the cam body 243B from the rear side to the lower side.

The pivot of the cam body 243B releases the end surface of the cam body 243B from the bearing 233 as depicted in FIG. 3. This causes the pivot shaft 243A receiving the force from the driving gear G2 and the biasing force of the compression coil spring 242 to press the pressure pad 220 rearward, thus moving the pressure pad 220 from the first position to the second position. In that situation, the cam body 243B presses the movable guide 250 downward, thus moving the movable guide 250 from the third position to the fourth position.

Then, the position of the pressure arm 130 is switched from the retract position to the pressure position. This generates the nipping force to nip the endless belt 210 between the heating roller 110 and the pressure pad 220 and between the heating roller 110 and the pressure roller 230, thus switching the width of nip portion from the first width N1 to the second width N2 smaller than the first width N1.

In that situation, the interval between the pressure pad 220 and the pressure roller 230 is small. This could make the heating roller 110 have difficulty in entering the interval, slacking the endless belt 210. In this embodiment, since the movable guide 250 is positioned in the fourth position that is the outside of the third position, appropriate tension can be applied to the endless belt 210.

As depicted in FIG. 3, when the rotation driving force in the direction opposite to the predefined direction is inputted to the driving gear G2 depicted in FIG. 7B in a state where the pressure pad 220 released from the nipping force is positioned in the second position, the swing gear G1 rotates and moves to the position depicted in FIG. 7A. This moves the pivot shaft 243A of the cam 243 frontward along the arc-like hole 121A and switches the orientation of the end surface of the cam body 243B from the lower side to the rear side.

The pivot of the cam body 243B causes the end surface of the cam body 243B to press the bearing 233 as depicted in FIG. 2. This causes the pivot shaft 243A receiving the force from the driving gear G2 and the reaction force of the force generated by pressing the bearing 233 by the cam body 243B, to move the pressure pad 220 frontward, thus moving the pressure pad 220 from the second position to the first position. In that situation, the cam body 243B is released from the movable guide 250. This moves the movable guide 250 from the fourth position to the third position by the aid of biasing force of an unillustrated spring.

Then, the position of the pressure arm 130 is switched from the retract position to the pressure position. This generates the nipping force to nip the endless belt 210 between the heating roller 110 and the pressure pad 220 and between the heating roller 110 and the pressure roller 230, thus switching the width of nip portion from the second width N2 to the first width N1 larger than the second width N2.

A large interval between the pressure pad 220 and the pressure roller 230 makes the heating roller 110 easily enter the interval, which could cause a large load on the endless belt 210. In this embodiment, since the movable guide 250 is positioned in the third position that is the inside of the fourth position, the endless belt 210 can be prevented from receiving the large load.

The embodiment as described above can obtain the following effects. Namely, moving the pressure pad 220 to the first position or the second position by use of the actuator 240 changes the width of the nip portion between the pressure unit 200 and the heating roller 110. Since the nipping force between the heating roller 110 and the pressure pad 220 and between the heating roller 110 and the pressure roller 230 is generated both of when the pressure pad 220 is positioned in the first position and when the pressure pad 220 is positioned in the second position, two peaks of the nipping pressure are made regardless of the width of the nip portion. This prevents releasability of the sheet S from the endless belt 210 from deteriorating when the width of the nip portion is changed depending, for example, on the type of the sheet S.

Of the two pressure members (the pressure pad 220 and the pressure roller 230), one of the pressure members which is located on the downstream side in the movement direction of the predefined portion 211 of the endless belt 210 is fixed to the pressure arm 130. This can change the nip width without moving the pressure member located downstream in the movement direction, thus improving the releasability of the sheet S.

In this embodiment, since the cam body 243B makes contact with the bearing 233 that does not rotate, the cam body 243B can be prevented from wearing away.

In this embodiment, since there is provided the displacement mechanism 260 that displaces the position of the movable guide 250 along with the movement of the actuator 240, the tension of the endless belt 210 is constant regardless of the change in the nip width.

In this embodiment, since the movable guide 250 is moved by using the cam 243 for moving the pressure pad 220, the number of parts or components can be smaller, for example, than a configuration in which the movable guide is moved by another cam different from the cam for moving the pressure pad.

Second Embodiment

Subsequently, a second embodiment of the present teaching is explained in detail with reference to the drawings as appropriate. In the second embodiment, the structure of the fixing apparatus 100( ) according to the first embodiment is partially changed, and thus the parts or components, which are substantially the same as or equivalent to those of the first embodiment, are designated by the same reference numerals, any explanation therefor will be omitted.

Figure 8:
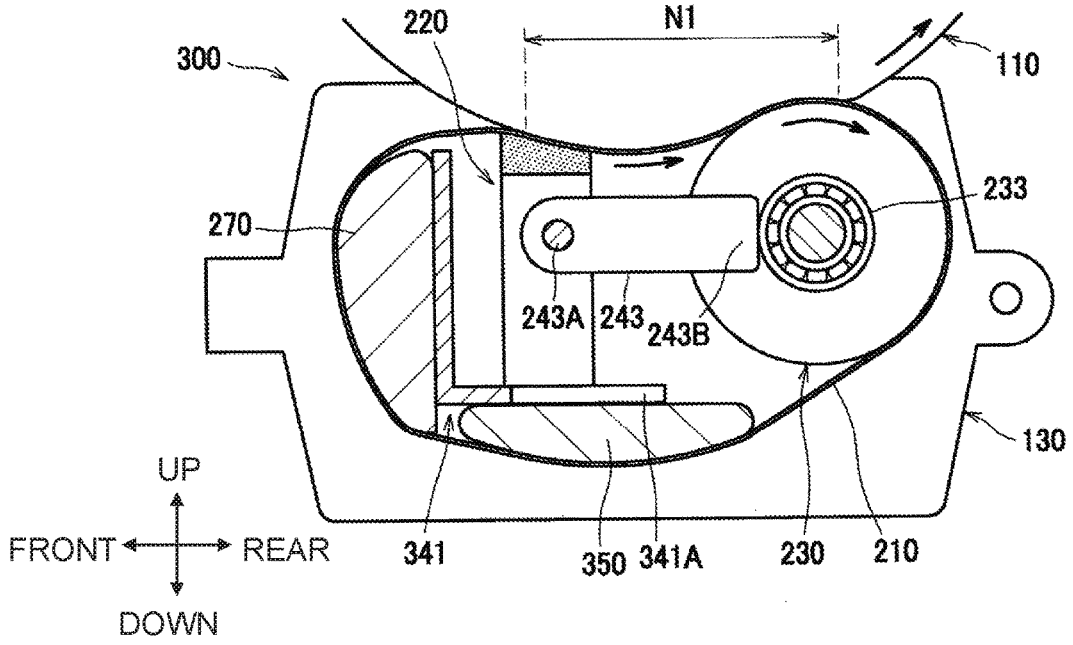
FIG. 8 is a cross-sectional view, when seen from the right side, of a fixing apparatus according to a second embodiment, wherein the nip width is the first width.
Figure 9:
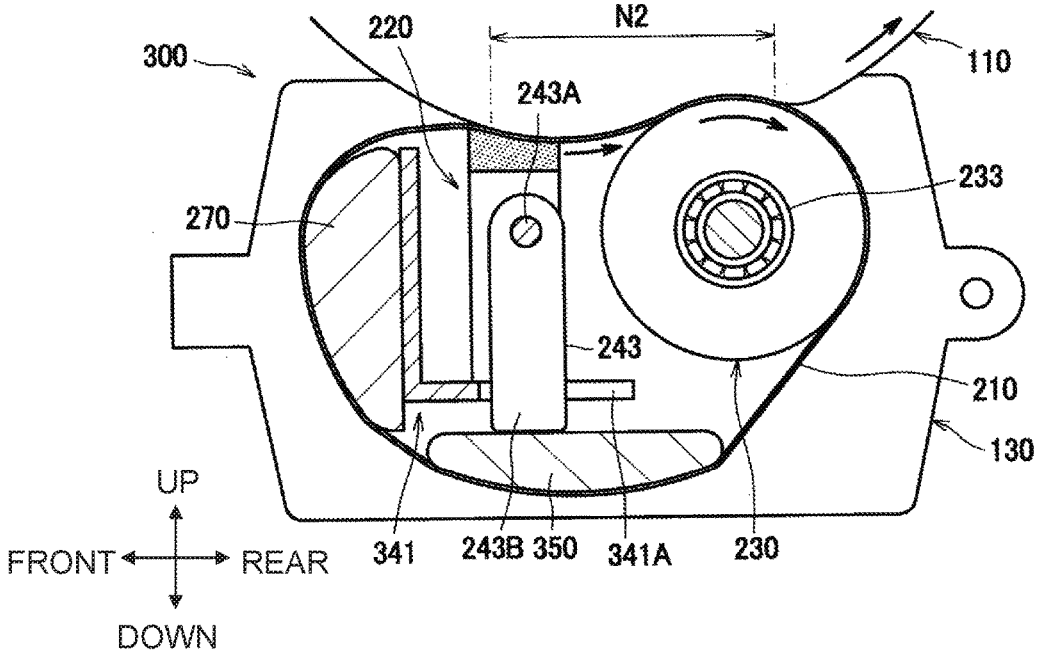
FIG. 9 is a cross-sectional view, when seen from the right side, of the fixing apparatus according to the second embodiment, wherein the nip width is the second width.

As depicted in FIGS. 8 and 9, a fixing apparatus 300 according to the second embodiment is different from the fixing apparatus 100 according the first embodiment in that the pressure pad 220 is fixed to the pressure arm 130 and the pressure roller 230 is movable in the front-rear direction relative to the pressure arm 130. In the second embodiment, the pressure roller 230 corresponds to the first pressure member and the pressure pad 220 corresponds to the second pressure member.

The pressure pad 220 is fixed to a stay 341 fixed to the pressure arm 130. The pressure pad 220 includes the cam 243. The pressure pad 220 pivotally supports the pivot shaft 243A of the cam 243. Specifically, a hole, of the pressure pad 220, through which the pivot shaft 243A passes is a circular hole, which is different from the long hole 222A of the first embodiment. This fixes the position of the cam 243 relative to the pressure pad 220 in the front-rear direction and the up-down direction. Thus, in the second embodiment, the mechanism with the swing gear G1 described in the first embodiment is unnecessary, making it possible to simplify the structure driving the cam 243.

The stay 341 has a L-shape in cross section. The stay 341 has a slit 341A through which the cam body 243B passes. The movable guide 350 of the second embodiment is different from that of the first embodiment only in that the movable guide 350 of the second embodiment includes no protrusion 254, and any other structures thereof are substantially the same as those of the first embodiment.

Figure 10:
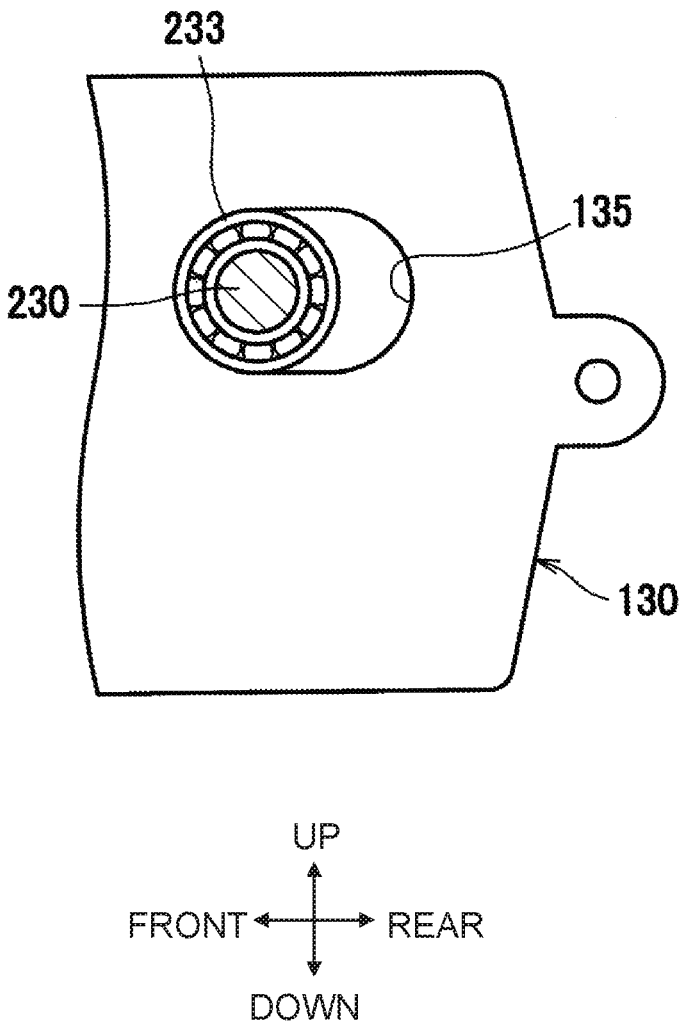
FIG. 10 depicts a coupling portion between a pressure arm and a bearing.

The pressure roller 230 is movable between the first position depicted in FIG. 8 and the second position depicted in FIG. 9 in the front-rear direction. Specifically, as depicted in FIG. 10, the pressure arm 130 includes a fitting hole 135 into which the bearing 233 supporting the pressure roller 230 is fitted. The fitting hole 135 is a long hole that is long in the front-rear direction. That is, the length of the fitting hole 135 in the front-rear direction is longer than an outer diameter of the bearing 233. The bearing 233 is supported by the fitting hole 135 to be movable in the front-rear direction.

Figure 11:
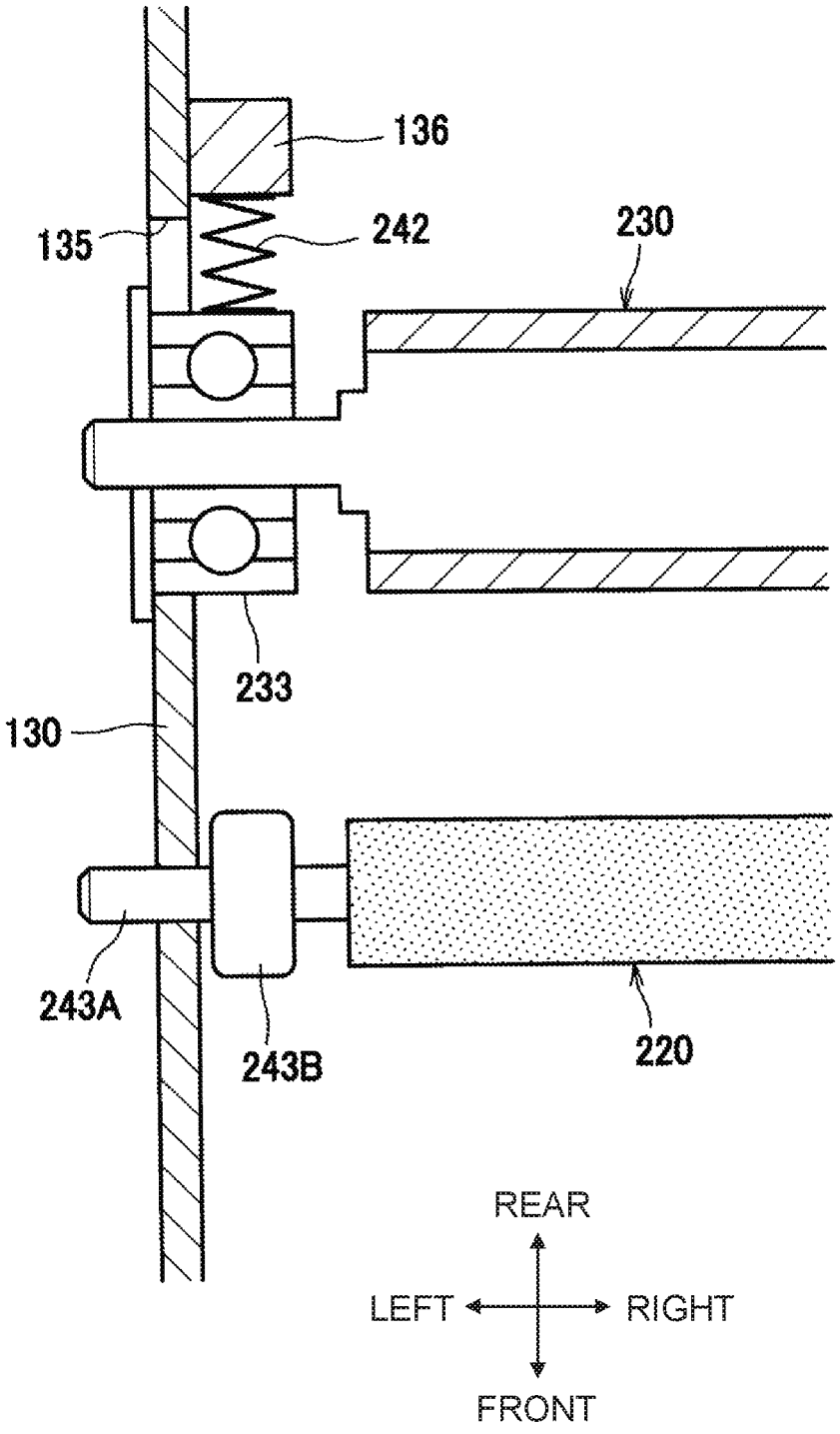
FIG. 11 is a cross-sectional view, when seen from the above, of a structure around the pressure roller taken along a surface perpendicular to the up-down direction.

As depicted in FIG. 11, the pressure arm 130 includes the compression coil spring 242 that is an example of the first spring. Specifically, the pressure arm 130 includes a support part 136 disposed on the rear side of the bearing 233 of the pressure roller 230 such that the support part 136 is separated from the bearing 233. The compression coil spring 242 is disposed between the bearing 233 and the support part 136 to bias the pressure roller 230 toward the pressure pad 220.

As depicted in FIG. 8, the pressure roller 230 is positioned in the first position in a state where the end surface of the cam body 243B is in contact with the bearing 233. As depicted in FIG. 9, the pressure roller 230 is positioned in the second position by the aid of the biasing force of the compression coil spring 242 in a state where the end surface of the cam body 243 is separated from the bearing 233.

Next, movement and operation of components or parts of the fixing apparatus 300 are explained. The switching operation of the pressure arm 130 is the same as that of the first embodiment, and thus the explanation therefor will be omitted.

As depicted in FIG. 8, when pivot driving force in the clockwise direction indicated in the drawing is inputted to the cam 243 in a state where the pressure roller 230 is positioned in the first position, the cam body 243B pivots clockwise as indicated in the drawing, thus releasing the end surface of the cam body 243B from the bearing 233. This causes the compression coil spring 242 to move the pressure roller 230 from the first position to the second position, as depicted in FIG. 9. In that situation, the cam body 243B presses the movable guide 350 downward, thus moving the movable guide 350 from the third position to the fourth position.

As depicted in FIG. 9, when pivot driving force in the counterclockwise direction indicated in the drawing is inputted to the cam 243 in a state where the pressure roller 230 is positioned in the second position, the cam body 243B pivots counterclockwise as indicated in the drawing so that the end surface of the cam body 243B retracts from the movable guide 350. This causes an unillustrated spring to move the movable guide 350 from the fourth position to the third position. Making the front end of the cam body 243B contact with the bearing 233 causes the cam body 243B to press the bearing 233 rearward against the biasing force of the compression coil spring 242. This moves the pressure roller 230 from the second position to the first position.

The second embodiment can obtain the following effects. Namely, since the cam 243 is provided in the pressure pad 220 of which position in the front-rear direction and the up-down direction is fixed, the structure transmitting driving force to the cam 243 can be simplified.

Making the cam body 243B contact with the bearing 233 that does not rotate prevents the cam body 243B from wearing away.

Third Embodiment

Subsequently, a third embodiment of the present teaching is explained in detail with reference to the drawings as appropriate. In the third embodiment, the structure of the fixing apparatus 100 according to the first embodiment is partially changed, and thus the parts or components, which are the same as or equivalent to those of the first embodiment, are designated by the same reference numerals, any explanation therefor will be omitted.

Figure 12:
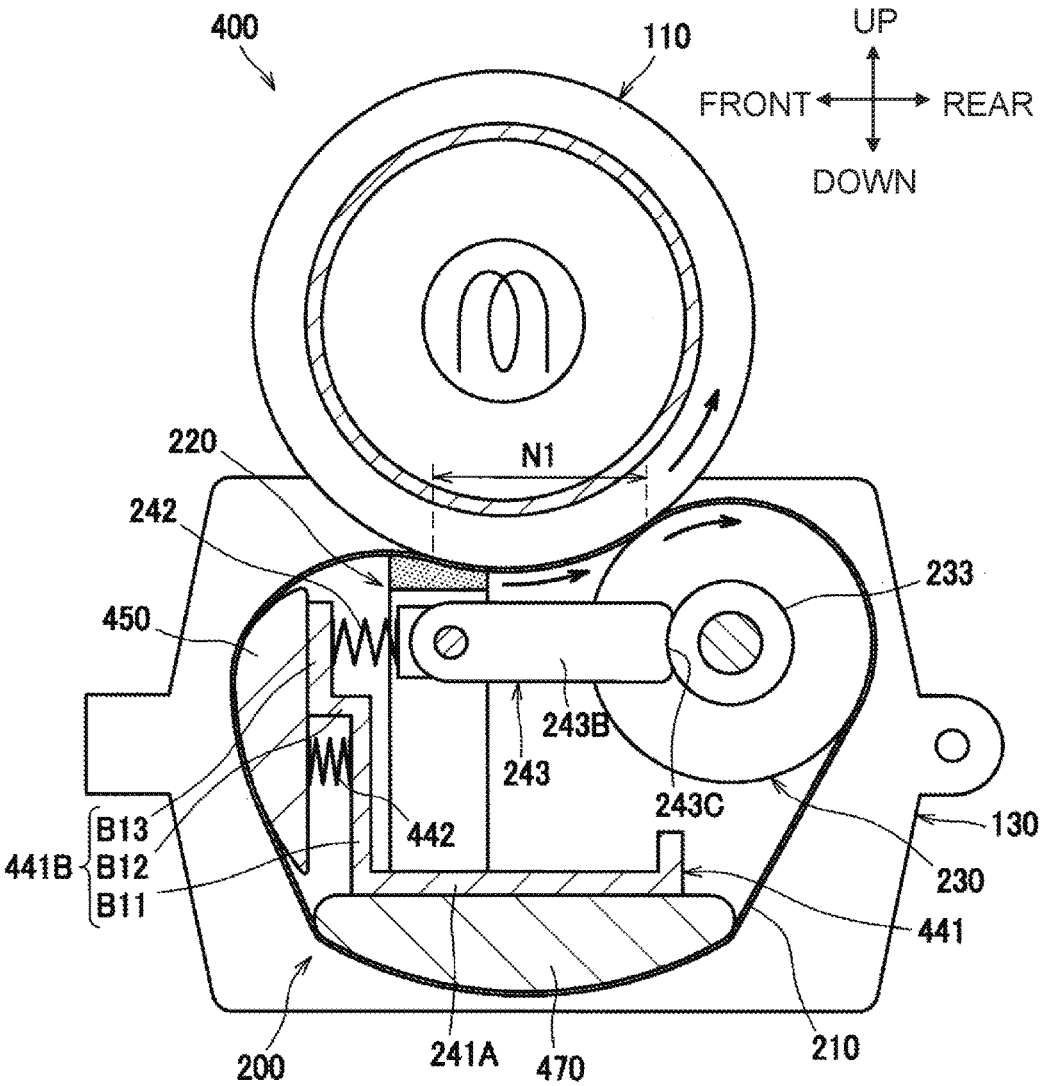
FIG. 12 is a cross-sectional view, when seen from the right side, of a fixing apparatus according to a third embodiment, wherein the nip width is the first width.

As depicted in FIG. 12, a fixing apparatus 400 according to the third embodiment is differed from the fixing apparatus 100 according to the first embodiment mainly in that the movable guide 450 moves by the aid of force applied from the endless belt 210. Specifically, the fixing apparatus 400 is different from the fixing apparatus 100 in that a stay 441 includes no hole A1 and includes a front wall 441B different from the front wall 241B of the first embodiment.

The front wall 441B includes: a first wall B11 extending upward from a front end of the lower wall 241A; a second wall B12 extending frontward from an upper end of the first wall B11; and a third wall B13 extending upward from a front end of the second wall B12. An end of the compression coil spring 242 is fixed to a rear surface of the third wall B13.

The movable guide 450 is supported by the pressure arm 130 to be movable in the front-rear direction. A coupling structure coupling the movable guide 450 with the pressure arm 130 may be similar to the coupling structure coupling the movable guide 250 with the pressure arm 130 in the first embodiment.

A guide biasing spring 442, which is an exemplary second spring, is provided between the first wall B1 and the movable guide 450. The guide biasing spring 442 biases the movable guide 450 frontward, namely, biases the movable guide 450 from the third position toward the fourth position. In the third embodiment, the displacement mechanism includes the guide biasing spring 442 and the coupling structure coupling the movable guide 450 with the pressure arm 130, and does not include the cam 243 moving the pressure pad 220.

A fixing guide 470 is fixed to a lower surface of the lower wall 241A. Outer surfaces of the movable guide 450 and the fixing guide 470 each have a substantially arc shape in cross section and are in contact with the inner circumferential surface of the endless belt 210.

The end surface of the cam body 243B, namely the surface contacting with the bearing 233 includes a concave 243C receiving a part of the bearing 233. The concave 243C has an arc-like shape in cross section along an outer circumference surface of the bearing 233.

Subsequently, movement and operation of components or parts of the fixing apparatus 400 are explained. The switching operation of the pressure arm 130 and the movement of the pressure pad 220 are the same as those of the first embodiment, and thus the explanation therefor will be omitted.

Figure 13:
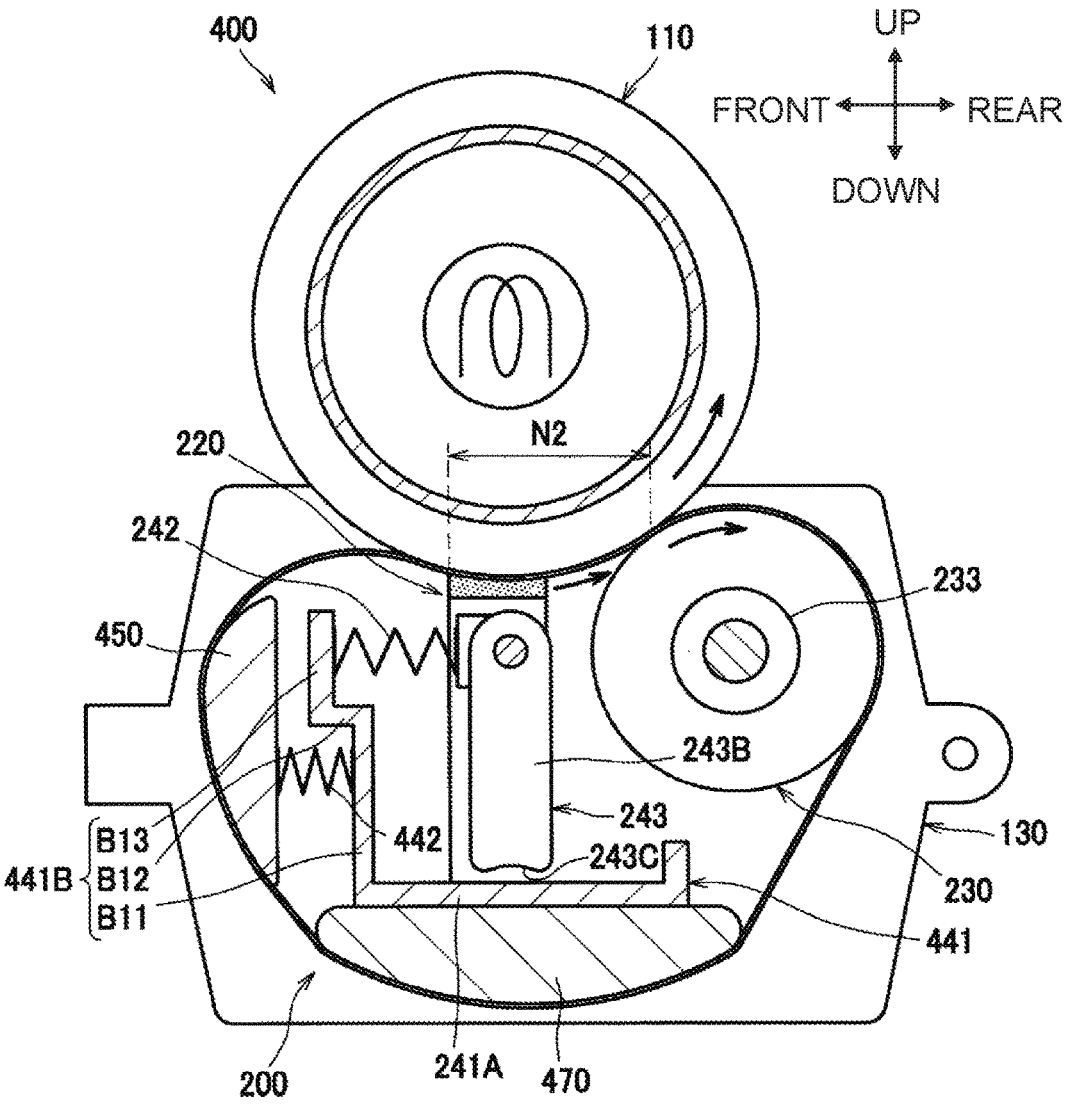
FIG. 13 is a cross-sectional view, when seen from the right side, of the fixing apparatus according to the third embodiment, wherein the nip width is the second width.

When the pressure pad 220 moves from the first position to the second position to cause the pressure unit 200 to press the heating roller 110 (an order from FIG. 12 to FIG. 13), the endless belt 210 becomes slack due to a narrow interval between the pressure pad 220 and the pressure roller 230. In that case, proper tension can be applied to the endless belt 210 by moving the movable guide 450 from the third position to the fourth position by the aid of biasing force of the guide biasing spring 442.

When the pressure pad 220 moves from the second position to the first position to cause the pressure unit 200 to press the heating roller 110 (an order from FIG. 13 to FIG. 12), the tension of the endless belt 210 increases due to a long interval between the pressure pad 220 and the pressure roller 230. In that case, the endless belt 210 presses the movable guide 450 against the biasing force of the guide biasing spring 442, thus moving the movable guide 450 from the fourth position to the third position. This prevents large load from being applied to the endless belt 210 unlike, for example, a structure in which the movable guide 450 is fixed in the fourth position.

The third embodiment can obtain the following effects. Namely, since the end surface of the cam body 243B includes the concave 243C, the pressure pad 220 can be satisfactorily held in the first position.

The guide biasing spring 442, which biases the movable guide 450 from the third position toward the fourth position, moves the movable guide 450 depending on the degree of tension of the endless belt 210. In that structure, the movable guide 450 moves without using the cam 243 moving the pressure pad 220, thus reducing the load which may otherwise be applied to the cam 243.

The present teaching is not limited to the above embodiments, and can be used in various aspects described below.

In the above embodiments, the pressure arm 130 is an exemplary frame. The present teaching, however, is not limited thereto. The frame may be, for example, a fixing frame. In that case, the elastic body may bias the heating roller 110 toward the fixing frame.

In the above embodiments, the heating roller 110 is an exemplary cylindrical member. The present teaching, however, is not limited thereto. For example, when a heat source is provided in the endless belt, the cylindrical member may be, for example, a pressure roller.

In the above embodiments, only the first pressure member is moved. The present teaching, however, is not limited thereto. The nip width may be changed by moving both of the first pressure member and the second pressure member.

In the above embodiments, the second position is closer to the second pressure member than the first position. The present teaching, however, is not limited thereto. The second position may be farther from the second pressure member than the first position. Namely, the first spring may bias the first pressure member in a direction away from the second pressure member.

In the above embodiments, the cam 243 that pivots is an exemplary cam. The present teaching, however, is not limited thereto. The cam may be, for example, a liner-motion cam that moves on a straight line.

The springs described in the above embodiments are not limited to those described in the above embodiments. The springs may be any other springs such as a torsion spring and a plate spring.

In the above embodiments, the hole and the protrusion form the mechanism that movably supports the member such as the pressure pad 220 and the movable guide 250. The present teaching, however, is not limited thereto. For example, a protrusion and a guide rail that movably supports the protrusion may form a mechanism that movably supports the member such as the pressure pad 220 and the movable guide 250.

In the structure that moves the first pressure member by using the swing gear as in the first embodiment, the first spring and the cam may be omitted. In that case, for example, a fixing guide fixed to the stay 241 may be provided, instead of the movable guide 250 that is an exemplary belt guide, in the position where the movable guide 250 is provided (the position depicted in FIG. 2). Or, a cam moving the belt guide may be provided independently of the actuator.

The elements described in the embodiments and modified embodiments may be executed or used by way of various combinations.

What is claimed is:

1. A fixing apparatus, comprising:

an endless belt;

a cylindrical member;

a first pressure member which is in contact with an inner circumferential surface of the endless belt and is configured to nip the endless belt between itself and the cylindrical member;

a second pressure member which is in contact with the inner circumferential surface of the endless belt and is configured to nip the endless belt between itself and the cylindrical member;

a frame configured to support the first pressure member and the second pressure member;

an actuator configured to move the first pressure member between a first position and a second position different from the first position in a running direction, the running direction being a direction in which the endless belt runs between the first pressure member and the second pressure member; and an elastic body configured to generate nipping force to nip the endless belt between the first pressure member and the cylindrical member and between the second pressure member and the cylindrical member, wherein the nipping force by the elastic body is generated between the first pressure member and the cylindrical member and between the second pressure member and the cylindrical member, both in a case that the first pressure member is positioned in the first position and a case that the first pressure member is positioned in the second position, wherein the actuator includes a cam configured to move the first pressure member from the second position to the first position, wherein the actuator includes a first spring configured to bias the first pressure member from the first position to the second position, and wherein the cam is configured to move the first pressure member against biasing force of the first spring from the second position to the first position.

2. The fixing apparatus according to claim 1, wherein the first spring is configured to bias the first pressure member toward the second pressure member;

wherein the cam is attached to the first pressure member; and wherein the first pressure member is positioned in the first position in a state where the cam is in contact with the second pressure member.

3. The fixing apparatus according to claim 2, wherein the first pressure member is positioned in the second position in a state where the cam is out of contact with the second pressure member.

4. The fixing apparatus according to claim 2, wherein the first pressure member is disposed at a position upstream of the second pressure member in the running direction, the first pressure member configured to be movable relative to the frame in the running direction, and wherein the second pressure member is not moved relative to the frame in a direction orthogonal to a width direction of the endless belt.

5. The fixing apparatus according to claim 4, wherein the frame includes an insertion hole into which a pivot shaft of the cam is inserted, and wherein a length of the insertion hole in the running direction is longer than an outer diameter of the pivot shaft of the cam.

6. The fixing apparatus according to claim 2, wherein the second pressure member includes a pressure roller and a bearing configured to support a rotation shaft of the pressure roller, and wherein the first pressure member is positioned in the first position in a state where the cam is in contact with the bearing.

7. The fixing apparatus according to claim 6, wherein a contact surface of the cam with the bearing has a concave which receives a part of the bearing.

8. A fixing apparatus, comprising:

an endless belt;

a cylindrical member;

a first pressure member which is in contact with an inner circumferential surface of the endless belt and is configured to nip the endless belt between itself and the cylindrical member;

a second pressure member which is in contact with the inner circumferential surface of the endless belt and is configured to nip the endless belt between itself and the cylindrical member;

a frame configured to support the first pressure member and the second pressure member;

an actuator configured to move the first pressure member between a first position and a second position different from the first position in a running direction, the running direction being a direction in which the endless belt runs between the first pressure member and the second pressure member; and an elastic body configured to generate nipping force to nip the endless belt between the first pressure member and the cylindrical member and between the second pressure member and the cylindrical member, wherein the actuator includes a cam configured to move the first pressure member from the second position to the first position, wherein the nipping force by the elastic body is generated between the first pressure member and the cylindrical member and between the second pressure member and the cylindrical member, both in a case that the first pressure member is positioned in the first position and a case that the first pressure member is positioned in the second position, wherein the first pressure member is disposed at a position downstream of the second pressure member in the running direction, the first pressure member configured to be movable relative to the frame in the running direction, wherein the second pressure member is not moved relative to the frame in a direction orthogonal to a width direction of the endless belt, wherein the cam is attached to the second pressure member, and wherein the first pressure member is positioned in the first position in a state where the cam is in contact with the first pressure member.

9. The fixing apparatus according to claim 8, wherein the first pressure member is positioned in the second position in a state where the cam is out of contact with the first pressure member.

10. The fixing apparatus according to claim 8, wherein the first pressure member includes a pressure roller and a bearing configured to support a rotation shaft of the pressure roller, wherein the frame includes a fitting hole into which the bearing is fit, and wherein a length of the fitting hole in the running direction is longer than an outer diameter of the bearing.

11. The fixing apparatus according to claim 10, wherein the cam is configured to make contact with the bearing.

12. A fixing apparatus, comprising:

an endless belt;

a cylindrical member;

a first pressure member which is in contact with an inner circumferential surface of the endless belt and is configured to nip the endless belt between itself and the cylindrical member;

a second pressure member which is in contact with the inner circumferential surface of the endless belt and is configured to nip the endless belt between itself and the cylindrical member;

a frame configured to support the first pressure member and the second pressure member;

an actuator configured to move the first pressure member between a first position and a second position different from the first position in a running direction, the running direction being a direction in which the endless belt runs between the first pressure member and the second pressure member, the actuator including a cam;

an elastic body configured to generate nipping force to nip the endless belt between the first pressure member and the cylindrical member and between the second pressure member and the cylindrical member; and a belt guide which is in contact with the inner circumferential surface of the endless belt and is configured to be movable between a third position and a fourth position which is farther away from a pivot center of the cam than the third position, wherein the nipping force by the elastic body is generated between the first pressure member and the cylindrical member and between the second pressure member and the cylindrical member, both in a case that the first pressure member is positioned in the first position and a case that the first pressure member is positioned in the second position, and wherein movement of the belt guide is linked to movement of the actuator.

13. The fixing apparatus according to claim 12, wherein the actuator includes a cam which is configured to move the first pressure member from the second position to the first position, and is configured to move the belt guide from the third position to the fourth position.

14. The fixing apparatus according to claim 13, wherein the cam is attached to the first pressure member, wherein, when the cam is in contact with the second pressure member and out of contact with the belt guide, the first pressure member is in the first position and the belt guide is in the third position, and wherein, when the cam is out of contact with the second pressure member and in contact with the belt guide, the first pressure member is in the second position and the belt guide is in the fourth position.

15. The fixing apparatus according to claim 12, further comprising a second spring configured to bias the belt guide from the third position to the fourth position.

16. A fixing apparatus, comprising:

an endless belt;

a cylindrical member;

a first pressure member which is in contact with an inner circumferential surface of the endless belt and is configured to nip the endless belt between itself and the cylindrical member;

a second pressure member which is in contact with the inner circumferential surface of the endless belt and is configured to nip the endless belt between itself and the cylindrical member;

a frame configured to support the first pressure member and the second pressure member;

an actuator configured to move the first pressure member between a first position and a second position different from the first position in a running direction, the running direction being a direction in which the endless belt runs between the first pressure member and the second pressure member; and an elastic body configured to generate nipping force to nip the endless belt between the first pressure member and the cylindrical member and between the second pressure member and the cylindrical member, wherein the nipping force by the elastic body is generated between the first pressure member and the cylindrical member and between the second pressure member and the cylindrical member, both in a case that the first pressure member is positioned in the first position and a case that the first pressure member is positioned in the second position, wherein the actuator includes:

a cam configured to move the first pressure member from the second position to the first position;

a driving gear;

a pivot shaft of the cam extending in a width direction of the endless belt and configured to engage with the first pressure member; and a swing gear fixed to the pivot shaft and configured to rotate and move along an outer circumferential surface of the driving gear in a state of being engaged with the driving gear.

17. The fixing apparatus according to claim 16, wherein the first pressure member includes a long hole into which the pivot shaft is inserted; and a length of the long hole is longer than an outer diameter of the pivot shaft in a direction in which the nipping force is generated.

* * * * *